US007370688B2

(12) United States Patent
Biramben et al.

(10) Patent No.: US 7,370,688 B2
(45) **Date of Patent: *May 13, 2008**

(54) LOST WAX MOULDING METHOD WITH CONTACT LAYER

(75) Inventors: Arnaud Biramben, Paris (FR); Christian Marty, Boulogne Billancourt (FR); Patrice Ragot, Bessancourt (FR); Jean-Christophe Husson, Les Ulis (FR); Franck Truelle, Argenteuil (FR); Patrick Chevalier, Sannois (FR); Serge Fargeas, Paris (FR)

(73) Assignee: Snecma, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/125,084

(22) Filed: May 10, 2005

(65) Prior Publication Data

US 2005/0252633 A1 Nov. 17, 2005

(30) Foreign Application Priority Data

May 12, 2004 (FR) ..... 04 05145

(51) Int. Cl.
*B22C 1/00* (2006.01)
*B22C 9/04* (2006.01)

(52) U.S. Cl. ..... 164/519; 164/35

(58) Field of Classification Search ..... 164/34–36, 164/516–519

See application file for complete search history.

(56) References Cited

U.S. PATENT DOCUMENTS

| | | | | |
|---|---|---|---|---|
| 3,859,153 | A | 1/1975 | Beyer et al. | |
| 5,618,633 | A | 4/1997 | Swanson et al. | |
| 5,766,329 | A * | 6/1998 | LaSalle et al. | 106/38.9 |
| 5,779,785 | A * | 7/1998 | Payton et al. | 106/487 |
| 6,431,255 | B1 * | 8/2002 | Ghosh et al. | 164/361 |
| 6,863,700 | B2 * | 3/2005 | Yoshida et al. | 51/309 |

FOREIGN PATENT DOCUMENTS

| | | | |
|---|---|---|---|
| EP | 0 399 727 A1 | | 11/1990 |
| WO | WO 98/32557 | * | 7/1998 |
| WO | WO 01/45876 | * | 6/2001 |

OTHER PUBLICATIONS

U.S. Appl. No. 11/125,084, filed May 10, 2005, Biramben et al.
U.S. Appl. No. 11/127,092, filed May 12, 2005, Biramben et al.

* cited by examiner

*Primary Examiner*—Kuang Lin
(74) *Attorney, Agent, or Firm*—Oblon, Spivak, McClelland, Maier & Neustadt, P.C.

(57) ABSTRACT

A method of manufacture of a multilayer ceramic shell mould whereof at least one contact layer out of a wax master pattern or a part to be manufactured, or other similar material, includes a step of preparing a first slip containing ceramic particles and a binder; a step of dipping the master pattern in a first slip; a step of forming the contact layer, and a step of depositing sand particles particles onto the layer and drying the contact layer. The ceramic particles of the slip are mullite particles and the slip includes a texturing agent.

18 Claims, No Drawings

LOST WAX MOULDING METHOD WITH CONTACT LAYER

BACKGROUND OF THE INVENTION

1. Field of the Invention

The present invention relates to the manufacture of parts such as complex geometry metals vanes and shrouds according to the technique known as lost wax moulding.

2. Discussion of the Background

For the manufacture of vanes and shrouds for turbojet engines, such as rotor or stator parts, or structural parts according to this technique, a master pattern is prepared first of all, using wax or any other similar material easily disposable at a later stage. If necessary, several master patterns are gathered into a cluster. A ceramic mould is prepared around this master pattern by dipping in a first slip to form a first layer of material in contact with the surface thereof. The surface of said layer is reinforced by sanding, for easier bonding of the following layer, and the whole is dried, which compose respectively the stuccowork and drying operations. The dipping operation is then repeated in slips of possibly different compositions, an operation always associated with the successive stuccowork and drying operations. A ceramic shell formed of a plurality of layers is then provided. The slips are composed of particles of ceramic materials, notably flour, such as alumina, mullite, zircon or other, with a colloidal mineral binder and admixtures, if necessary, according to the rheology requested. These admixtures enable to control and to stabilise the characteristics of the different types of layers, while breaking free from the different physical-chemical characteristics of the raw materials forming the slips. They may be a wetting agent, a liquefier or a texturing agent relative, for the latter, to the thickness requested for the deposit.

The shell mould is then dewaxed, which is an operation thereby the material forming the original master pattern is disposed of. After disposing of the master pattern, a ceramic mould is obtained whereof the cavity reproduces all the details of the master pattern. The mould is then subjected to high temperature thermal treatment or "baked", which confers the necessary mechanical properties thereto. The shell mould is thus ready for the manufacture of the metal part by casting.

After checking the shell mould for internal and external integrity, the following stage consists in casting a molten metal into the cavity of the mould, then in solidifying said metal therein. In the field of lost wax moulding, several solidification techniques are distinguished currently, hence several casting techniques, according to the nature of the alloy and to the expected properties of the part resulting from the casting operation. It may be a columnar structure oriented solidification (DS), a mono-crystalline structure oriented solidification (SX) or an equiaxed solidification (EX) respectively. Both first families of parts relate to superalloys for parts subjected to high loads, thermal as well as mechanical in the turbojet engine, such as HP turbine vanes.

After casting the alloy, the shell is broken by a shaking-out operation, the manufacture of the metal part is finished.

During the moulding stage, several types of shells may be used via several methods. Each shell should possess specific properties enabling the type of solidification desired.

For example, for equiaxed solidification, several different methods may be implemented one using an ethylsilicate-based binder, another using a colloidal silica-based binder.

For oriented solidification, the shells may be realised out of different batches, silica-alumina, silica-zircon or silica based batches.

The first layer for each of these shells plays an essential part. It forms the interface between the shell mould and the cast alloy. It should, in the case of columnar or mono-crystalline structure oriented solidification, be non-reactive with the cast alloy. In the case of equiaxed solidification, it should enable equiaxed germination of the grains. Besides, the integrity of this contact layer determines the final quality of the cast part, in terms of surface condition in particular.

The first layer should indeed meet certain requirements in order to avoid defects such as loss of ceramic cohesion and surface defects.

Loss of contact layer cohesion before or during the casting, may generate detrimental marks on the parts.

Surface defects result from excessive microporosity of the contact layer which generates surpluses forming bulges on the parts.

Major surface defects often result from a surface capillary phenomenon at the interface between the wax master pattern and the first layer. After dipping the first layer, during sprinkling, the grits will form stacks, which exhibit numerous capillaries. Each one acts as a suction cup which causes a depression. The smaller the capillary, the greater the depression. This corresponds to insufficient thickness of the first layer. Depression promotes capillary rising of the slip towards the plaster and so, until the liquid column thus formed restores the differential pressure. This is followed by the formation of a recessed zone with a cavity leading to the formation of surface defects. This phenomenon is worsened by too thin a first layer.

Both these types of defect, major defects in foundry, are associated with contact layer intrinsic antagonistic characteristics. Indeed, to avoid loss of ceramic cohesion, the purpose is to obtain thin and even deposit of the first layer, whereas to avoid surface defects, the deposit of the first layer should be even, but thick.

The properties of the contact layer should therefore enable to find a compromise between said antagonistic characteristics, in order to break free from all defects on the parts.

SUMMARY OF THE INVENTION

The invention meets these objectives with the following method.

The method of manufacture of a multilayer ceramic shell mould whereof at least one contact layer out of a wax master pattern or other similar material, consisting in dipping the master pattern in a slip containing ceramic particles and a binder, and admixtures in order to form said contact layer, in depositing the sable particles onto the layer and in drying said contact layer. According to the invention, the method is characterised in that the ceramic particles of the slip are mullite particles. In particular, the admixture comprises a wetting agent, a liquefier and a texturing agent.

Thanks to the composition of the slip, it becomes possible to meet the objectives set for all foundry moulds, whereof the properties comply with the casting conditions meeting in particular the requirements of the DS and SX solidification methods. In particular, the contact layer does react with cast superalloys.

To comply with economic constraints associated with wastage, the slip is composed advantageously of mullite flour in an amount ranging from 65 to 90% in weight, without zircon. Similarly, the sand particles or "stuccos", for this contact layer, are formed of mullite grains and not zircon grains.

Adding admixture to the slip enables to control the deposits on wax and to ensure optimal characteristics in terms of thickness and distribution on the parts.

Preferably and to comply with environmental constraints, the binder is a water-based colloidal solution, such as colloidal silica, and not an alcohol-based binder.

The deposit of the contact layer on wax, associated with reinforcement by sprinkling mullite sand whereof the size distribution ranges from 80 to 250 microns enables to obtain very good cohesion of the first layer and very good surface condition of the cast parts.

DETAILED DESCRIPTION OF THE PREFERRED EMBODIMENTS

The method is described more in detail thereunder.

The method of manufacturing shell moulds comprises a first stage consisting in making the master pattern out of wax or another similar material known in the art. The most generally known is wax. According to the type of part, the master patterns may be grouped in clusters in order to manufacture several of them simultaneously. The master patterns are shaped to the sizes of the finished parts, allowing for the contraction of alloys.

The manufacturing stages of the shell are preferably carried out by a robot whereof the movements have been programmed for optimal action on the quality of the deposits realised, and for breaking free from the geometric aspect of the different vanes and shrouds.

Slips are prepared in parallel wherein the master patterns or the cluster are dipped in succession to deposit the ceramic materials.

The composition of the first slip in weight percentage is as follows:

| | |
|---|---|
| mullite flour | 65-80 |
| colloïdal silica binder | 20-35 |
| water | 0-5 |
| 3 organic admixtures which are a wetting agent, a liquefier and a texturing agent, respectively. | |

The 3 admixtures fulfil the following functions, respectively:

The liquefier enables to obtain more rapidly the rheology required during the manufacture of the layer. It acts as a dispersing agent. It is selected preferably among the following compounds: amino acids, ammonium polyacrylates, carboxylic tri-acids with alcohol groups.

The wetting agent facilitates the coating of the layer during the dipping process. It is selected preferably among the following compounds: polyatkylene fat alcohols, alkoxylate alcohols.

The texturing agent enables to optimise the layer for obtaining suitable deposits. It is selected preferably among: ethylene oxide polymers, xanthan gums or guar gums.

Once the master pattern withdrawn from the first slip after an immersion phase, the master pattern thus covered is subjected to dripping, then coating. Then, "stucco" grains, grits, are applied, by sprinkling so as not to disturb the thin contact layer. Mullite is used whereof the size distribution in this first layer is thin. It ranges from 80 to 250 microns. The surface condition of the finished parts depends partially thereof.

The layer is dried.

The tests have shown that to obtain satisfactory rheological characteristics, the incorporation of admixtures was advantageous, let alone necessary.

A dipping phase is then performed in a second slip to form a so-called "intermediate" layer.

As previously, "stucco" is deposited, before drying.

The master pattern is then dipped in a third slip to form the layer 3 which is the first so-called "reinforcing" layer.

The stucco is then applied, before drying. The third-slip-dipping, stucco application and drying operations are repeated to obtain the requested shell thickness. For the last layer, a glazing operation is performed.

The second and third slips may comprise a mixture of alumina and mullite flours in amounts ranging between 45 and 95% in weight, and mullite grains in amounts ranging between 0 and 25% in weight.

The dipping operations for the different layers are conducted differently and adapted for obtaining homogeneous distribution of the thicknesses and preventing the formation of bubbles, in particular in trapped zones.

The last layer formed is finally dried.

The shell may thus comprise 5 to 12 layers.

The baking cycle of the moulds comprise a temperature rise phase for a set period, a soak time at baking temperature, then a cool-down phase. The baking cycle is selected to optimise the mechanical properties of the shells so as to enable cold handling without any risk of breakage and to minimise their sensitivities to thermal shocks which might be generated during the various casting phases.

A method of shell mould manufacture has been described using the contact layer according to the invention. This contact layer may be associated with all types of layers to suit the requirements, even if necessary with layers made of zircon particles.

The invention claimed is:

1. A method of manufacture of a multilayer ceramic shell out of a master pattern of a part to be manufactured, said method comprising the steps of:

preparing a first slip containing ceramic particles and a binder, wherein the first slip comprises mullite flour in an amount ranging between 65 and 80 in weight %, dipping the master pattern in said slip and forming a contact layer, and depositing sand particles on said contact layer and drying said contact layer, wherein said sand particles are mullite grains having a grain size distribution range between 80-250 micron, wherein the first slip does not contain any zircon and the first slip comprises a wetting agent, a liquefier and a texturing agent, forming additional layers on said contact layer thereby forming a ceramic shell;

disposing of said master pattern thereby forming a ceramic mould;

baking said ceramic mould;

casting a metal part in said ceramic mould;

wherein said contact layer forms an interface between said ceramic mould and said metal part, and wherein said additional layers comprise a mixture of alumina and mullite flours in amounts ranging between 45 and 95% in weight, and mullite grains in amounts ranging between 0 and 25% in weight.

2. A method according to claim 1, further comprising selecting the wetting agent among polyalkylene fat alcohols or alkoxylate alcohols.

3. A method according to claim 1, further comprising selecting the liquefier among the amino acids, ammonium polyacrylates or carboxylic tri-acids with alcohol groups.

4. A method according to claim 1, further comprising selecting the texturing agent among ethylene oxide polymers, xanthan gums or guar gums.

5. A method according to claim 1, wherein the binder is based on water-based mineral colloïdal solutions.

6. A method according to claim 1, wherein said depositing comprises sprinkling the sand particles.

7. A method of manufacturing said part, said method comprising the method of claim 1, and further comprising a step of solidifying metal with columnar structure oriented solidification.

8. A method of manufacturing said part, said method comprising the method of claim 1, and further comprising a step of solidifying metal with mono-crystalline structure oriented solidification.

9. A method according to claim 5, wherein the binder is based on water-based colloïdal silica.

10. A method according to claim 1, wherein said additional layers include zircon particles.

11. A method according to claim 1, wherein said metal part is a part for a turbojet engine.

12. A method according to claim 2, further comprising selecting the liquefier among the amino acids, ammonium polyacrylates or carboxylic tri-acids with alcohol groups.

13. A method according to claim 12, further comprising selecting the texturing agent among ethylene oxide polymers, xanthan gums or guar gums.

14. A method according to claim 13, wherein the binder is based on water-based mineral colloïdal solutions.

15. A method according to claim 1, wherein said master pattern is made of wax.

16. The method according to claim 1, wherein said depositing of said sand particles is performed so as to control said after-baking porosity thereby controlling the shell mould's sensitivity to thermal shock to comply with casting conditions meeting stresses of a solidification method selected from the group consisting of an equiaxed solidification (EX), a columnar structure oriented solidification (DS) and a mono-crystalline structure oriented solidification (SX).

17. The method according to claim 16, wherein the binder is a water-based colloidal solution and not an alcohol-based binder.

18. The method according to claim 1, wherein said method is free of a step of including a ceramic based mat of reinforcing material in said shell mould.

* * * * *

UNITED STATES PATENT AND TRADEMARK OFFICE

CERTIFICATE OF CORRECTION

PATENT NO. : 7,370,688 B2
APPLICATION NO. : 11/125084
DATED : May 13, 2008
INVENTOR(S) : Arnaud Biramben et al.

It is certified that error appears in the above-identified patent and that said Letters Patent is hereby corrected as shown below:

Column 3, line 63, "Once the master pattern withdrawn from"
should read -- Once the master pattern is withdrawn from --.

Column 4, line 52, "grain size distribution range between 80-250 micron,"
should read -- grain size distribution range between 80-250 microns, --.

Signed and Sealed this

Sixteenth Day of December, 2008

JON W. DUDAS
*Director of the United States Patent and Trademark Office*